US008087457B2

(12) United States Patent
Kuzmichev

(10) Patent No.: US 8,087,457 B2
(45) Date of Patent: Jan. 3, 2012

(54) METHOD FOR A SHORT-TERM WELL OPERATION BY MEANS OF AN ELECTRICALLY-POWERED SUBMERSIBLE PUMPING UNIT (KUZMICHEV METHOD)

(76) Inventor: Nikolay Petrovich Kuzmichev, Alimetievsk (RU)

( * ) Notice: Subject to any disclaimer, the term of this patent is extended or adjusted under 35 U.S.C. 154(b) by 0 days.

(21) Appl. No.: 12/065,159

(22) PCT Filed: Jun. 30, 2006

(86) PCT No.: PCT/RU2006/000360

§ 371 (c)(1),
(2), (4) Date: Jun. 23, 2008

(87) PCT Pub. No.: WO2007/027124

PCT Pub. Date: Mar. 8, 2007

(65) Prior Publication Data

US 2008/0245530 A1 Oct. 9, 2008

(30) Foreign Application Priority Data

Sep. 2, 2005 (RU) ..... 2005128382

(51) Int. Cl.
*E21B 43/00* (2006.01)

(52) U.S. Cl. ..... 166/105

(58) Field of Classification Search ..... 166/105, 166/68; 415/901
See application file for complete search history.

(56) References Cited

U.S. PATENT DOCUMENTS 4,507,053 A * 3/1985 Frizzell ..... 417/12
4,678,404 A * 7/1987 Lorett et al. ..... 417/45
4,865,519 A * 9/1989 Diankui et al. ..... 415/210.1
6,092,600 A * 7/2000 McKinzie et al. ..... 166/266
6,167,965 B1 * 1/2001 Bearden et al. ..... 166/250.15

FOREIGN PATENT DOCUMENTS

RU 2057907 C1 4/1996
RU 2119578 C1 1/2007
SU 344109 A 8/1972
SU 1052651 A 11/1983
SU 1481382 A1 5/1989

OTHER PUBLICATIONS

Bogdanov, A.A., "Submersible Centrifugal Electric Pumps," Moscow, Costoptekhizdat, 1957, pp. 8-11.
Bogdanov, A.A., "Submersible Centrifugal Electric Pumps," Moscow, Costoptekhizdat, 1957, pp. 77-79.
Bogdanov, A.A., "Submersible Centrifugal Electric Pumps," Moscow, Costoptekhizdat, 1957, pp. 126, 128-30.

(Continued)

*Primary Examiner* — Kenneth L Thompson
(74) *Attorney, Agent, or Firm* — Volpe and Koenig, P.C.

(57) ABSTRACT

A method of short-term well operation using a submersible impeller pump unit is disclosed, the method includes the steps of alternating pumping a liquid out of a well and accumulating a liquid in the well, and adjusting an average integral-in-time capacity of the unit by changing a proportion between time intervals of pumping the liquid out and accumulating the liquid. The method further includes adjusting a pressure produced by the unit during the time interval of pumping the liquid out of the well, selecting a time interval of a complete operational cycle of the unit to have a production rate reduction factor greater than 0.95 as compared to continuous well operation, and selecting a factor of cyclic time interval of unit-turning-on equal to a ratio of the time intervals of pumping the liquid out and the complete operational cycle of the unit such that the factor is less than 50%.

1 Claim, 2 Drawing Sheets

OTHER PUBLICATIONS

Ivanov-Smolensky, A.V., "Electrical Machines," Moscow, Energy, 1980, pp. 435-436.
Schurov, V.I., "Technology and Equipment of Oil Production," Moscow, Nedra, 1983, pp. 412-417.
Reference Book for Oil Production, edited by Sh. K. Gimautdinov, Moscow, Nedra, 1974, pp. 269-272, 503-504.
www.oilcapital.ru/technologies/2005/09/051148_75257.shtml.
"Short-Term Well Operation and the Prospects of Oil-Production Equipment Development," Territoriya NEFTEGAZ, No. 6, 2005, pp. 23-36 (www.neftegas.info/neftegaz_arhive.html).
"Short-Term Well Operation—A New Approach to Economic Efficiency of Oil Production," Drilling & Oil, No. 6, 2005, pp. 16-17.
Ivanovsky, V.N., "Maximum and Minimum Allowable EPSPCU Rotor Rotating Frequencies While Adjusting Production Capacity for Frequency Converters," Reports at the XII-th All-Russian Technical Conference, "Manufacture & Operation of Submersible Electric Pump Units", Almetyevsk, Sep. 27-30, 2004.
Ageev, Sh. R.; Druzhinin, E. Yu., "Approaches to Increasing Technical Level of OJSC ALNAS Stages," Report at the XII-th All-Russian Technical Conference "Manufacture and Operation of Submersible Electric Pump Units", Almetyevsk, Sep. 27-30, 2004, pp. 5-6, 9-14.
ALNAS Submersible Contrifugal Pump Units. Guide for Operation, Almetyevsk, OJSC ALNAS, 2004, p. 41.

* cited by examiner

METHOD FOR A SHORT-TERM WELL OPERATION BY MEANS OF AN ELECTRICALLY-POWERED SUBMERSIBLE PUMPING UNIT (KUZMICHEV METHOD)

FIELD OF THE INVENTION

The invention relates to production of a liquid from wells by mechanical means and can be used for operating wells, preferably medium production rate and stripper oil wells, by means of submersible impeller, preferably centrifugal, pump units with controllable electrical drives.

BACKGROUND OF THE INVENTION

A method for continuous operation of prolific and medium range producing oil wells by means of electrically-powered submersible centrifugal pumping units (EPSCPUs) with uncontrollable electrical drives is known (Bogdanov, A. A. Submersible Centrifugal Electric Pumps. Moscow, Costoptekhizdat, 1957, p.p. 8-11).

The disadvantage of the method is high electric power consumption caused by the need to control the delivery of a downhole submersible pump delivery by throttling (Bogdanov, A. A. Submersible Centrifugal Electric Pumps. Moscow, Costoptekhizdat, 1957, p.p. 77-79). When medium production rate wells, that is, wells having the a liquid production rate of from 20 $m^3$/day to 80 $m^3$/day, are operated, the electric power consumption increases because of low efficiency values of electrically-powered submersible centrifugal pumps (EPSCPs) within the present delivery range (Ageev, Sh. R., Druzhinin, E. Yu. Approaches to Increasing Technical Level of OJSC ALNAS Stages. Report at the XII-th All-Russian Technical Conference "Manufacture & Operation of Submersible Electric Pump Units," Almetyevsk, Sep. 27-30, 2004, p.p. 5-6, 9-14). The increased electric power consumption results in reduction of the oil production profitableness.

A method for continuous operation of producing prolific wells by means of an EPSCPU with a controllable electrical drive is known (Ivanovsky, V. N. Maximum and Minimum Allowable EPSPCU Rotor Rotating Frequencies while Adjusting Production Capacity for Frequency Converters. Report at the XII-th All-Russian Technical Conference "Manufacture & Operation of Submersible Electric Pump Units,"" Almetyevsk, Sep. 27-30, 2004). The method consists in controlling the production unit capacity by changing an EPSCP rotation speed using change of a frequency of the alternating current (AC) powering a submersible electric motor (SEM).

The disadvantage of the method is the high cost of the equipment. The most expensive equipments are control stations (CSs) with frequency converters (FCs) for EPSCPUs. Because of their high costs, the CSs with FCs are used generally in prolific wells where capital expenditures are compensated within acceptable periods of time. Use of the CSs with the FCs in the medium production rate wells is usually unprofitable.

A method for periodical operation of producing stripper wells by means of an EPSCPUs with controllable electrical drives is known, said method comprising alternated pumping a liquid out of a well and accumulating the liquid in the well (RU 2,119,578). An aspect of the present method is that the EPSCPUs are not turned off during accumulation of the liquid in the well while operation continues at a reduced rotation speed so as to maintain a maximum EPSCP head at which a delivery is absent. The EPSCP head is not controlled by changing the rotation speed when pumping the liquid from the well. The prior art method is used in case if a check valve of an EPSCPU is not hermetical.

The disadvantages of the method are the low profitability of oil production caused by the high cost of the equipment because the latter comprises CSs with FCs, the high specific electric power consumption because the EPSCPU operates for the most of time at zero capacity, and small values of the time between overhauls caused by non-optimal working modes of the equipment and bad cooling conditions for the most time.

The closest prior art analogue taken as a prototype for the invention is a method for periodical operation of stripper and medium range producing wells by electrically-powered submersible centrifugal pumping units with uncontrollable electrical drives (Bogdanov, A. A. Submersible Centrifugal Electric Pumps. Moscow, Costoptekhizdat, 1957, p.p. 126, 128-130), said method comprising alternated pumping a liquid out of a well and accumulating the liquid in the well when the unit is turned off. The average capacity of the unit is controlled by changing a proportion between a liquid pumping-out-of-well duration and a liquid accumulation-in-well duration.

The disadvantage of the method is that placement of a well to periodical operation is always associated with loss of a certain oil amount as compared to an amount that could be produced in continuous operation (Schurov, V. I. Technology and Equipment of Oil Production. Moscow, Nedra, 1983, p.p. 412-417).

Further, increase of the number of EPSCPU starts in periodic well operation as compared to continuous operation and increase of a frequency of acting the relevant electrical, mechanical and hydraulic starting overloads result in reduction of the time between overhauls and the service life of the producing unit (Ivanovsky, V. N. Maximum and Minimum Allowable EPSPCU Rotor Rotating Frequencies while Adjusting Production Capacity for Frequency Converters. Report at the XII-th All-Russian Technical Conference "Manufacture & Operation of Submersible Electric Pump Units," Almetyevsk, September 27-30, 2004, p. 1).

Reduction of oil production volumes and reduction of the time between equipment overhauls result in reduction of the oil production profitability.

DISCLOSURE OF THE INVENTION

It is an object of the invention to increase the profitability of operating the producing wells by means of submersible impeller, preferably centrifugal, pump units with controllable electrical drives. The profitability is determined by liquid production volumes, electric power consumption, a cost of the equipment, a time between overhauls of the equipment and a service life thereof. Therefore, to accomplish the object of the invention, it is necessary to improve said profitability components.

A method for short-term well operation by means of an electrically-powered submersible centrifugal pumping unit with a controllable electrical drive (hereinafter referred to as "short-term well operation") is disclosed and comprises alternated pumping a liquid out of a well and accumulating the liquid in the well when the unit is turned off. There is the step of controlling an average integral-in-time capacity of the unit by changing a proportion between a liquid pumping-out-of-well duration and a liquid accumulation-in-well duration.

The inventive method differs from the prototype in that a well operation period duration equal to a sum of the liquid pumping-out-of-well duration and the liquid accumulation-in-well duration is selected so as to have a production rate reduction factor greater than 0.95 as compared to continuous operation. When pumping the liquid out of the well, a pressure developed by the unit is controlled by changing a pump rotation speed such that the pump operates at the efficiency of not less than 0.9 of a maximum value for a given rotation speed. The well is operated by the unit having a capacity greater than 80 $m^3$/day. A unit turn-on duration equal to a proportion between the liquid pumping-out-of-well duration and a well operation period duration is set less than 50%.

The unit can operate in a short-term or periodical short-term mode when the operation duration of the unit is not greater than an operation duration necessary to provide the thermal equilibrium between members of the unit and the surroundings.

The present combination of essential features is novel because a similar combination of essential features is absent in the prior art method for well operation by mechanical means.

The combination of disclosed technical solutions is also not evident because, along with the positive effect upon one of oil production profitability components that should be increased in accordance with the object of the invention, each technical solution simultaneously has the negative effect upon another component thereof.

Basic disadvantages of the closest prior art analogue are reduction of oil production volumes as compared to continuous well operation, and reduction of the time between overhauls due to increase of a frequency of acting the impact starting overloads to the equipment which results in reduction of the well operation profitability.

Oil production losses during short-term well operation are reduced by reducing a well operation period duration. The well operation period duration reduction allows decrease of a difference between an average integral differential pressure drawdown in short-term operation and a depression in continuous operation thereby to reduce the oil production losses.

However, the well operation period duration reduction in the method of the invention makes the frequency of acting the impact starting overloads yet higher than that in the prototype, implies additional reduction of the time between overhauls and the service life of the equipment, and reduces the oil production profitability, respectively.

Manufacturers of the EPSCPUs do not recommend operation thereof in a periodical mode and do not maintain supplier guaranties for the submersible equipment operated in the periodical mode (ALNAS Submersible Centrifugal Pump Units. Guide for Operation of ПЦЭНУА РЭ. ЕЮТИ.Н.354.000 РЭ.Almetyevsk, OJSC ALNAS, 2004, p. 41).

Because of this reason, reduction of the well operation period duration is not practiced to reduce the oil production losses.

Use of frequency converters in short-term well operation to provide "soft" shock-free start of units allows prevention of reducing the time between overhauls and the service life of the equipment because the impact starting overloads acts. This in turn allows essential reduction of the well operation period duration and reduction of the oil production losses to minimum when shifting the wells from continuous to short-term operation.

The considered technical solution also is not evident because, first, the major purpose of the CSs with the FCs is to provide the controllability of the producing well capacity. Elimination of impact starting overloads due to "soft" start is always considered as an additional ability of the FCs. This ability is the major reason of using the CSs with the FCs in short-term operation.

Second, the CSs with the FCs are expensive equipment. Capital expenditures for purchase thereof usually are not compensated within acceptable periods of time in the medium production rate and especially stripper wells. Therefore, use of the expensive CSs with the FCs does not allow accomplishment of the object of the invention, that is, increase of the oil production profitability.

In short-term operation, the equipment cost is reduced by means of the FC which increases a frequency of the alternating current powering the SEM, and a rotation speed of the EPSCP, respectively, that makes it possible to decrease overall dimensions thereof while keeping the power constant. Increase of the AC frequency also allows decrease of overall dimensions of a lubricant oil-filled transformer (LOFT) for oil production at constant capacity.

Reduction of the overall dimensions implies reduction of material consumption and labor consumption in manufacture of the equipment and therefore results in increase of its cost. Thus, increase of the cost of the equipment set because of including the expensive CS with the FC in short-term well operation is compensated by reduction of the SEM, EPSCP and LOFT costs.

Application of the present technical solution in the method according to the invention is not as evident as seems at first sight. Increase of the rotation speed of the EPSCPs results in a significant acceleration of their wear-out (Ivanovsky, V. N. Maximum and Minimum Allowable EPSPCU Rotor Rotating Frequencies while Adjusting Production Capacity for Frequency Converters. Report at the XII-th All-Russian Technical Conference "Manufacture & Operation of Submersible Electric Pump Units," Almetyevsk, September 27-30, 2004) and therefore decreases the time between overhauls (TBO) and the service life of the equipment, which has the negative effect upon the profitability of oil production.

Elimination of the present contradiction is provided by reduction of a producing equipment turn-on duration which is determined by a proportion between a liquid pumping-out-of-well duration and a well operation period duration, said proportion being expressed as percentage. A well operation period consists of the liquid pumping-out-of-well duration and the liquid accumulation-in-well duration. When the liquid is accumulated in the well, the producing unit is turned off, the EPSCP does not operate and therefore wear-out is absent. The less is the EPSCPU turn-on duration the more is the time between overhauls associated with the pump wear-out.

The equipment turn-on duration is equal to a proportion of the well production rate and the capacity of the unit. Therefore, the ratio of increasing the time between overhauls associated with the pump wear-out is equal to a proportion of the capacity of the unit and the well production rate. In short-term well operation, the capacities of producing units are several times greater than the well production rate, which makes it possible to decrease the EPSCPU turn-on duration and not only to compensate for the pump wear-out accelerations completely because of increasing the rotation speed, but also to increase the time between overhauls associated with the pump wear-out.

Thus, the present invention is a combination of several technical solutions. If we consider the technical solutions individually, they have factors having negative effect along with factors having positive effect upon accomplishment of the object of invention, that is, increase of the oil production profitability. Therefore, expedience of their use is not evident for a person skilled in the art. The object of the invention is accomplished only by combination of all technical solutions because said combination eliminates available contradictions. At the same time, there are factors as follows in short-term well operation according to the claimed invention.

1. Significant decline of oil production volumes inherent in the prototype in short-term well operation is reduced by decreasing the well operation period duration. But simultaneously, the time between overhauls and the service life of the equipment are decreased because of increasing the frequency of acting the impact starting overloads, and as a consequence, the oil production profitability decreases.

2. The time between overhauls is increased by eliminating the impact starting overloads because of "soft" starting the EPSCPU using the FCs. But the CSs with the FCs are expensive thereby to decrease the profitability of oil production.

3. Increase of the cost of the equipment set when it includes the expensive CSs with the FCs is compensated because of reducing the overall dimensions of the equipment and the cost thereof, respectively, by increasing the AC frequency and respective increasing the EPSCPU rotation speed. But simultaneously, the time between overhauls is reduced because of increasing the EPSCP wear-out rate which implies reduction of the oil production profitability.

4. Increase of the time between overhauls associated with the pump wear-out, implemented by reducing the EPSCPU turn-on duration in short-term well operation, allows compensation of reducing the time between overhauls associated with the wear-out of the EPSCP when the rotation speed thereof increases.

Short-term well operation of the invention simultaneously has positive effect upon all factors having an influence upon the profitability of oil production. Such operation allows not only elimination of disadvantages inherent in the prior art methods for well operation by mechanical means while maintaining the advantages thereof, but also acquisition of new advantages absent in the prior art methods.

The positive effect upon individual components of oil production, as achieved by the combination of technical solutions in short-term well operation, is greater than the result of influence of each technical solution individually, in other words, the synergistic effect takes place.

Above all, such a possibility appears because short-term well operation allows division of the methods for controlling the capacity of the pumping unit and the pressure developed thereby.

In case of the rotation speed change, the parameters of the centrifugal pump vary according to the relations as follows (FIG. 1):

$$\frac{Q_1}{Q_H} = \frac{n_1}{n_H};\ \frac{H_1}{H_R} = \left(\frac{n_1}{n_H}\right)^2;\ \frac{N_1}{N_H} = \left(\frac{n_1}{n_H}\right)^3;$$

where $n_1/n_R$ is the relation of real pump rotation speed to the rated one (the relative pump rotation speed);

$Q_1/Q_R$ is the relation of real pump delivery to the rated one (the relative pump delivery);

$H_1/H_R$ is the relation of real pump head to the rated one (the relative pump head);

$N_1/N_R$ is the relation of real pump capacity to the rated one (the relative pump capacity).

The principal distinction of the controlling method in short-term well operation consists in that the EPSCP rotation speed in short-term well operation is determined only from the need to provide a required EPSCP head (EPSCPU pressure). Simultaneous change of the EPSCP delivery (EPSCPU capacity) has no negative effect upon the controlling process.

The relative rotation speed and the relative delivery as functions of the relative head are as follows:

$$\frac{n_1}{n_H} = \frac{Q_1}{Q_H} = \sqrt{\frac{H_1}{H_R}} = \left(\frac{H_1}{H_R}\right)^{0,5}$$

Due to the EPSCP rotation speed and delivery change depending upon the square root of the head, in short-term well operation it is possible to provide effectively deep control of the pressure developed by the unit, in other words, by slightly changing the pump rotation speed it is possible to change the head thereof within a significant range (FIG. 2).

The average integral capacity of the EPSCPU in short-term well operation is controlled by changing the proportion between the liquid pumping-out-of-well duration and the liquid accumulation-in-well duration:

$$Q_{A1} = \frac{t_{P\text{-}OUT}}{t_{P\text{-}OUT} + t_{ACC}} \cdot \int_0^{t_{P\text{-}OUT}} Q(t)\,dt,$$

where $Q_{AI}$ is the average integral capacity of the unit;

Q(t) is the instantaneous capacity of the unit;

$t_{P\text{-}OUT}$ is the liquid pumping-out-of-well time;

$t_{ACC}$ is the liquid accumulation-in-well time.

The liquid pumping-out-of-well time and the liquid accumulation-in-well time can vary within wide limits thereby to provide deep control of the average integral capacity of the EPSCPU in short-term well operation.

The ability of deep controlling the EPSCPU capacity in short-term well operation makes it possible to match the parameters of the system "formation/producing well/pumping unit" when the operation conditions change within wide limits, and allows increase of extracted production volumes by 10 to 15% on average. Increase of the oil production volumes is in turn a deciding factor for increase of the oil production profitability.

Reduction of electric power consumptions because of operating all power-consuming members of the unit in modes close to optimal ones, that is, at maximum efficiency throughout the control range, is possible in short-term well operation along with use of all electric power saving methods typical for the prior art well operation methods; this provides the minimum electric power consumption as compared to all prior art methods for well operation by mechanical means irrespective of both operation conditions and duration.

The electric power saving is accomplished in the closest prior art analogue by using more productive EPSCPs having the larger efficiency. However, units having a capacity of not greater that 80 $m^3$/day are used in short-term well operation ((ALNAS Submersible Centrifugal Pump Units. Guide for Operation of ПЦЭНУА РЭ. ЕЮТИ.Н.354.000 РЭ.Almetyevsk, OJSC ALNAS, 2004, p. 41), said capacity being more than 2 times greater than the well production rate (Bogdanov, A. A. Submersible Centrifugal Electric Pumps. Moscow, Costoptekhizdat, 1957, p.p. 129-130).

EPSCPs having the delivery greater than 80 $m^3$/day, designed for operation of prolific wells and having the best power performance are used in short-term well operation (Ageev, Sh. R., Druzhinin, E. Yu. Approaches to Increasing Technical Level of OJSC ALNAS Stages. Report at the XII-th All-Russian Technical Conference "Manufacture & Operation of Submersible Electric Pump Units," Almetyevsk, Sep. 27-30, 2004, p.p. 5-6, 9-14). Therefore, the electric power saving greater than that of the prototype is possible in short-term well operation.

Despite the ability to control both the EPSCP head and delivery within a wide range, it is possible to provide change of the pressure in short-term well operation such that the pump operates at the maximum efficiency throughout the control range. This is possible because a position of a working point on an EPSCP head characteristic of be selected from the need to provide a required head.

Variation of the EPSCP delivery caused by changing the rotation speed thereof has no negative effect upon the controlling process. The average integral capacity of the unit can be determined accurately by changing the proportion between the liquid pumping-out-of-well duration and the well operation period duration.

The working point at the EPSCP universal characteristic will be always on the optimum mode parabola (FIG. 3) in short-term well operation. Deviation of the working mode from the optimal one can be caused by an error in measurement of the well operation modes and the equipment working modes. But the working mode efficiency will be not less than 0.9 of the maximum efficiency value at a given rotation speed in any case. The present requirement is impracticable in other well operation methods because it results in narrowing the EPSCP delivery control range down to a value unacceptable for real well operation conditions (Ivanovsky, V. N. Maximum and Minimum Allowable EPSCPU Rotor Rotating Frequencies while Adjusting Production Capacity for Frequency Converters. Report at the XII-th All-Russian Technical Conference "Manufacture & Operation of Submersible Electric Pump Units," Almetyevsk, Sep. 27-30, 2004, p.p. 6-14).

Short-term well operation makes it possible to optimize the working mode of not only the EPSCP but also the SEM, which is impossible in the prior art operation methods. In short term operation, there is no restriction of the rotation speed adjustment range caused by increasing the SEM capacity and rotation speed in direct proportion with the AC frequency increase, and by the cubic relationship between the power consumed by the EPSCP and the rotation speed thereof is cubic. With increasing the rotation speed, the power consumed by the EPSCP increases faster than the power output by the SEM (Ivanovsky, V. N. Maximum and Minimum Allowable EPSPCU Rotor Rotating Frequencies while Adjusting Production Capacity for Frequency Converters. Report at the XII-th All-Russian Technical Conference "Manufacture & Operation of Submersible Electric Pump Units," Almetyevsk, Sep. 27-30, 2004, p.p. 14-17, 22-23). To exclude overload of the SEM when the rotation speed changes significantly, it should be underloaded throughout the control range except the end point where the rotation speed is maximum.

In case of underloading the asynchronous electric motor, there is decrease of the efficiency and power factor (cos $\phi$) thereof while a multiplication result of said values characterizes the optimality level of the electric motor working mode (Ivanov-Smolensky, A. V. Electrical Machines. Moscow, Energy, 1980, pp. 435-436). The less is the multiplication result of the efficiency by cos $\phi$, the less effectively is the electric motor used.

The relationship between the power consumed by the EPSCP and the head thereof in short-term operation is expressed by cube of the square root of the head:

$$\frac{N_1}{N_H} = \left(\sqrt{\frac{H_1}{H_R}}\right)^3 = \left(\frac{H_1}{H_R}\right)^{1,5}$$

The EPSCP head change even in case of controlling it within a significant range in short-term well operation cause an insignificant change of the consumed power (FIG. 2).

Further, in short-term well operation, the SEM usually operates in the short-term mode (the typical mode S2 according to GOST 28173-39 E and IEC 34-1-82) or the periodical short-term mode (the typical mode S3 according to GOST 28173-39 E and IEC 34-1-82). A specific feature of said modes is that the SEM has no time to achieve the thermal equilibrium with the surroundings when it operates under the present conditions, that is, has no time for heating up to a maximum temperature at the given load. Therefore, overloads of the SEM are possible. The efficiency and power factor of the asynchronous electric motor changes insignificantly when loads are higher than a rated one (Ivanov-Smolensky, A. V. Electrical Machines. Moscow, Energy, 1980, pp. 435-436). The SEM operates under overloads as effectively as in the rated mode.

Another factor, which in short-term well operation will allow SEM operation in a mode close to the rated mode, is the higher probability that the design pressure of the EPSCPU will coincide with a real pressure developed by the unit when it operates within a particular well.

The parameters being the basis to calculate the EPSCP head when selecting the equipment before running into the well are as follows: a unit suspension depth, a dynamical level of a formation liquid in a well or a liquid column height over a pump intake, a gas pressure in the annulus, a wellhead flow line pressure; as a rule, said parameters are well-known and measured with an adequate accuracy. Among the parameters, there are a formation pressure, a bottom-hole pressure, a gas/oil factor, a saturation pressure, a well production water-cut, oil and formation water densities, etc.

It is rather difficult to accurately calculate the well production rate which is a determinative parameter for selection of the equipment and working modes thereof in other wall operation methods. Especially large deviations of the real production rate from the design one take place when new wells are put into operation, in wells after repairs with killing, after process operations for stimulating influx of the formation liquid to the well, etc.

For this reason, selection of the equipment and working modes thereof can be made with a higher accuracy in short-term well operation. Therefore, in case of short term operation it is easier to provide operation of the SEM in modes close to optimal ones at which the maximum efficiency is reached and the electric power consumption is minimized throughout the control range.

In case of short-term well operation, the LOFTs and FCs operate in similar modes which make it possible to reduce overall dimensions and accordingly the cost thereof.

Since the FCs have a direct current (DC) link, the additional electric power saving is accomplished in short-term well operation because of increasing the power factor (cos $\phi$) and reducing reactive currents therein, respectively.

EPSCP working mode optimization allows also increase of the time between overhauls because of increasing the pump performance reliability. When throttling is used to control the EPSCP, the pump operates in modes corresponding to the left part of the head characteristic. Operation in such modes results in acceleration of the wear-out in bearings of actuators because of increasing axial forces affecting them (Bogdanov, A. A. Submersible Centrifugal Electric Pumps. Moscow, Costoptekhizdat, 1957, p.p. 77-79) as well as increasing vibrations in the pump impellers and rotor (Ageev, Sh. R., Druzhinin, E. Yu. Approaches to Increasing Technical Level of OJSC ALNAS Stages. Report at the XII-th All-Russian Technical Conference "Manufacture & Operation of Submersible Electric Pump Units," Almetyevsk, Sep. 27-30, 2004, p.p. 2-4) thereby to reduce the time between overhauls and the service life of the submersible equipment.

Short-term well operation always and under any operation conditions allows provision of EPSCP operation in optimal modes to which the smaller values of axial forces and the minimum vibration level correspond. Under other equivalent conditions, operation of the EPSCP in optimal modes allows increase of the time between overhauls and the service life of the submersible equipment.

Increase of the time between equipment overhauls in short-term well operation is promoted by the ability to significantly weaken manifestations of practically all major complicating factors that occur in operation of a producing well, and to simplify control thereof.

To increase the time between overhauls in wells complicated by an elevated carryover of mechanical impurities, wear-proof versions of expensive EPSCPs are used. Similar result can be accomplished in short-term well operation due to application of the small-turn-on-time equipment when ordinary (not wear-proof) versions of inexpensive EPSCPs are used. Increase of the time between overhauls while keeping a constant cost of the equipment allows increase of the oil production profitability. Such ability is a unique aspect of short-term operation, and its realization is impossible in other methods of well operation.

EPSCPs having the capacity of greater than that 80 $m^3$/day used in short-term well operation have a greater height channels of actuators as compared to the pumps for medium production rate wells. A small channel height (3 to 4.5 mm) of the EPSCPs having deliveries of from 20 to 80 $m^3$/day is the major reason of stopping wells because of clogging the actuators by mechanical impurities, asphalt-resin-paraffin depositions (ARPDs) and salt depositions. The channels of actuators of the EPSCPs having the capacity of 125 to 250 $m^3$/day used in short-term well operation have the height of 5 to 7 mm. Therefore, the faults because of clogging the actuators by mechanical impurities, ARPDs and salt depositions take place much more rarely.

The significant capacity and power margin of the units in short-term well operation allows significant acceleration and quality improvement at well development after repairs with killing or at setting new wells into operation. Reduction of time periods results in increase of the well duty factor while quality improvement of developing the wells allows increase of their production rates. As a result, the volumes and profitability of oil production increase.

If a killing liquid of a greater density than a formation liquid should be pumped out of a well, and also during long well shutdowns when a formation liquid achieves a static level within the annulus, the cooling problem occurs in well development. When inflow of a liquid into a well is absent within the initial well development period, the liquid is pumped out of the annulus above the pump intake. The formation liquid in which an electric motor is arranged is practically immobile and is quickly heated. Removal of heat from the SEM degrades which results in overheat of the motor and the fault thereof.

Since EPSCPs having the capacity several times greater than the well production rate are used in short-term well operation, a killing liquid can be pumped out in well development significantly faster than in other well operation methods. Further, the more powerful SEM used in short-term well operation have large overall dimensions and respectively greater heat capacity than the SEM in short-term well operation and is heated more slowly. Therefore, the risk of overheating the SEM in well development is significantly lower.

The well development time and quality are determined by a rate of changing differential pressure drawdown. Due to use of high-capacity units for short-term well operation, it is succeeded to increase a rate of pumping a liquid out of a well and to obtain differential pressure drawdown change rate several times as great as that in other known methods for well operation by mechanical means.

Elevation of a rate of increasing differential pressure drawdown allows periodical process operations for intensifying the inflow of a liquid into a well similarly to swabbing and without stoppage and lift of the equipment out of the well which reduces the probability of mudding in a bottomhole formation zone (BHFZ) thereby to limit the inflow of the formation liquid into the well. Since a well production rate is kept constant for a long time, this makes it possible to increase the volumes and profitability of oil production.

More powerful SEMs have a greater starting moment which—along with use of the EPSCPs of a shorter length—creates more favorable conditions in short-term well operation for starting the units in both well development and operation.

Because of increasing the capacity of EPSCPUs in short term well operation, a flow velocity of a liquid increases within EPSCPs and oil well tubing (OWT) during pumping the liquid out of the well. Due to this, separation of depositions from inner surfaces of EPSCPs and OWT is enhanced while intensity of salt depositions and ARPDs decreases.

Increase of the liquid flow rate in pumps is accompanied with occurrence of stable oil-water emulsions having a greater viscosity as compared to both water and oil (Reference Book for Oil Production. Edited by Sh. K. Gimautdinov. Moscow, Nedra, 1974, p.p. 503-504). Emulsions of the greatest viscosity are formed at water cuttings of well production ranging from 40% to 80%.

Formation of viscous and stable oil-water emulsions results in the greater amount of electric power consumption, reduction of the time between equipment overhauls, complication of devices for accounting the amount of recovered products, necessity of additional investments for separation of emulsions into original components when producing stock-tank oil.

Segregation of a formation liquid within the annulus of a well takes place in short-term well operation. When a liquid accumulates in a well, oil of a lower density is concentrated in the upper portion of the liquid column while a mineralized formation water is concentrated in the lower portion thereof. Therefore, when a liquid is pumped out of a well in short-term well operation, the formation water is pumped out first, and then oil is pumped out, in other words, water cuttings of production are known to be greater than 80% at the beginning of pumping-out and less then 40% at the end thereof.

Oil-water emulsions formed in short-term well operation are unstable and have a viscosity not much greater than that of water and oil thereby to reduce electric power consumption for lifting the formation water out of the well. Further, expenses caused by negative effects of the improved stability of oil-water emulsions during transportation of crude oil and production of tank-stock oil are reduced.

Power consumed by EPSCPs operating in medium production rate wells is tens of kilowatts, therefore an amount of heat released therewith is rather considerable. Because of its low efficiency (30 to 60%), the EPSCP releases much more heat that the SEM having a higher efficiency (80 to 85%). A temperature of EPSCP impellers is tens of degrees higher than that of a formation liquid circumambient the impellers. If the EPSCPU capacity is controlled by throttling the pump when the EPSCP efficiency reduces yet more while heat removal degrades, then, the impeller temperature may achieve a temperature higher than 200° C. even in "cold" wells (≦90° C.).

Favorable conditions for accelerating salt deposition and ARPDs and also accelerating corrosion of members of the unit are created at the high EPSCPU temperature representative of long working mode in continuous and periodical well operation.

In short-term well operation, not only the SEM but other members of the submersible unit also operate in the short-term or periodical short-term mode which promotes the less heating of the unit. Therefore, salt deposition and ARPDs in the EPSCP and OWT as well as corrosion of the submersible equipment are slower in short-term well operation.

The difference between maximum temperatures of the SEM when it operates in the long-term mode (continuous and periodical well operation) and in the short-term or periodical short-term mode (short-term well operation) is a reserve for increasing a maximum allowable temperature in the producing unit suspension zone. Short-term operation of "hot" wells (>90° C.) makes it possible to use ordinary versions of SEMs that have the lower costs as compared to heat-resistant versions of SEMs while keeping the reliability at the allowable level. Such an approach to solution of the problem of increasing the equipment TBO in "hot" wells is possible only in short-term well operation and is unique.

The controlling process in short-term well operation by means of EPSCPUs with controllable electrical drives is the most effective because undesirable parameters change slightly during control.

Figure 1:
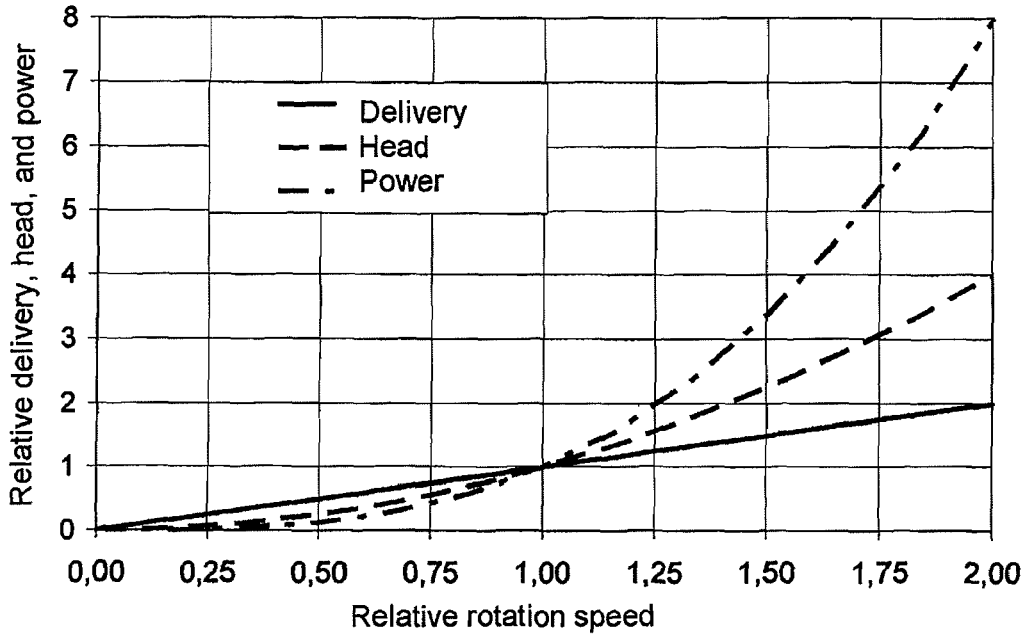
FIG. 1 shows is EPSCP parameters as a function of a rotation speed. Change of the rotation speed within the range of from 0 to 2 relative units causes similar change of the delivery wherein the head changes from 0 to 4 relative units and change of the pump-consumed power from 0 to 8 relative units.
Figure 2:
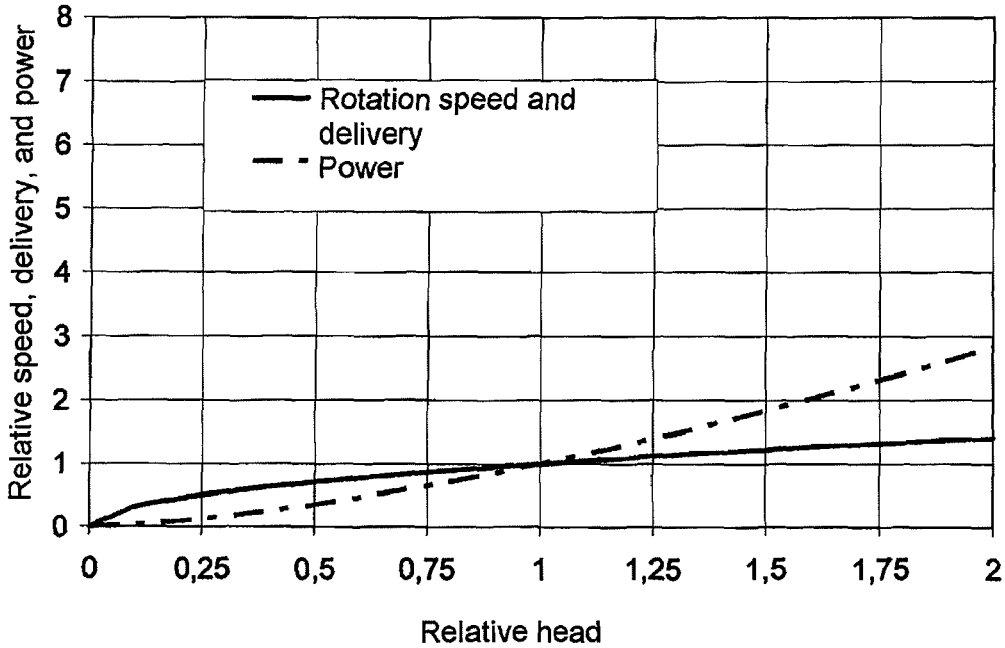
FIG. 2 shows the control characteristics in short-term well operation. Change of the relative head being the major control parameter in short-term well operation is within the range of from 0 to 2 relative units and causes change of the delivery from 0 to 1.4 relative units and change of the pump-consumed power from 0 to 2.8 relative units.
Figure 3:
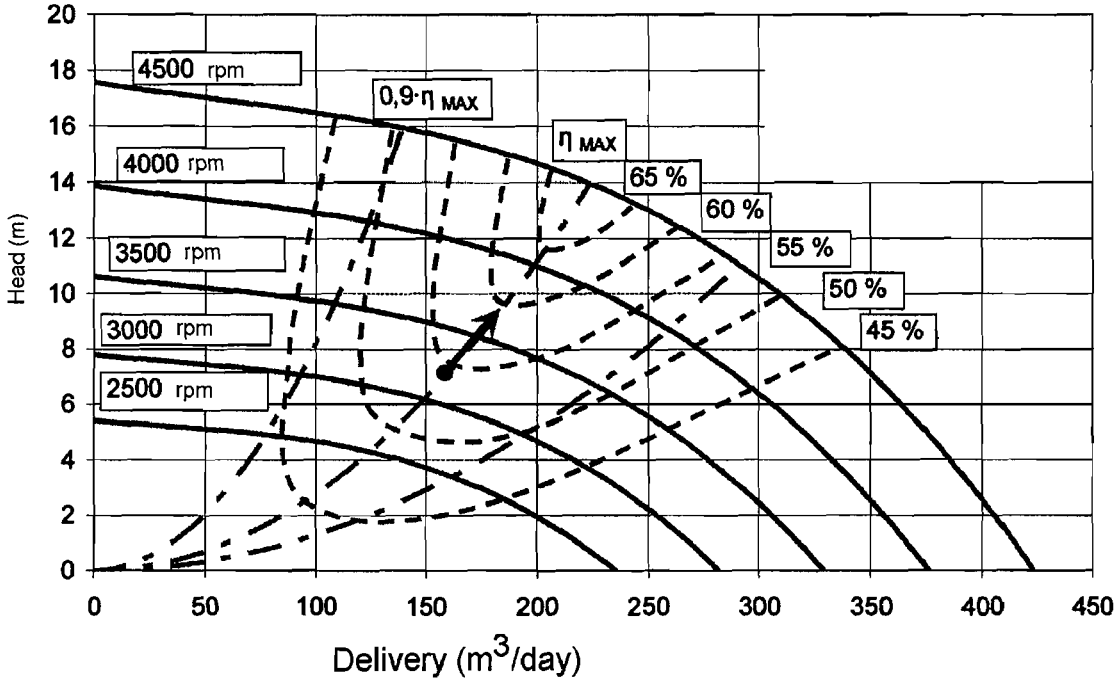

FIG. 3 illustrated the ability to optimize the EPSCP working mode in short-term well operation throughout the control range. The Figure shows the EPSCP universal characteristic. Said Figure shows change in EPSCP characteristics at different rotation speeds. The EPSCP working area shaded in FIG. 3 is defined by head characteristics at the maximum and minimum rotation speeds and also by similar mode parabolas at which the efficiency reduces to 0.9 of a maximum value ($0.9 \cdot \eta_{max}$) for a given rotation speed.

A section showing change of a working point position when the liquid is pumped out of the well is denoted by the thickened line on the optimal mode parabola $\eta_{max}$. Operation of the EPSCP in the optimal mode, that is, with the maximum efficiency, is always possible during control of the EPSCP in short-term well operation.

DETAILED DESCRIPTION OF THE EMBODIMENTS OF THE INVENTION

The method according to the invention is carried out as follows.

Equipment is selected and well operation modes and unit working modes are calculated from results of testing a well and bench testing a producing unit or a certificate thereof prior to well operation.

When using the prior art methods, well operation by EPSCPUs having the delivery greater than 80 $m^3$/day, that is, by the producing units designed for operation of prolific wells, is prohibited (ALNAS Submersible Centrifugal Pump Units. Guide for Operation of ПЦЭНУА РЭ. ЕЮТИ.Н.354.000 РЭ. Almetyevsk, OJSC ALNAS, 2004, p. 41). By contrast, EPSCPUs having the delivery greater than 80 $m^3$/day are used in short-term well operation because they have better energetic characteristics as compared to units for medium production rate wells (20 to 80 $m^3$/day) and allow oil production at lower electric power consumption.

A well operation mode is calculated so as to provide minimum reduction of the oil production volume as compared to continuous well operation.

A well operation period duration in the closest analogue is usually from several hours to one day. In this case, a typical value of the production rate reduction factor in is not greater than 0.9 as compared to continuous operation (Schurov, V. I. Technology and Equipment of Oil Production. Moscow, Nedra, 1983, p. 417). At its best, said factor achieves a value of 0.95 (Reference Book for Oil Production. Edited by Sh. K. Gimautdinov. Moscow, Nedra, 1974, p. 271).

An operation period duration should be tens of minutes in short-term well operation. Then, a production rate reduction factor is greater than 0.95 when a well is shifted from continuous to short-term operation.

To provide maximum reduction of the submersible equipment cost, it is necessary to increase the AC frequency and the EPSCPU rotation speed up to maximum possible values. Maximum allowable multiplicity of increasing the AC frequency and respective increasing the EPSCPU rotation speed for production-run SEMs designed to operate at the AC frequency of 50 Hz and synchronous rotation speed of 3000 rpm is 1.4 (Ivanovsky, V. N. Maximum and Minimum Allowable EPSPCU Rotor Rotating Frequencies while Adjusting Production Capacity for Frequency Converters. Report at the XII-th All-Russian Technical Conference "Manufacture & Operation of Submersible Electric Pump Units," Almetyevsk, Sep. 27-30, 2004, p. 17). In this case, the maximum allowable AC frequency will be 70 Hz and the EPSCPU rotation speed will be 4.200 rpm.

Since a row of EPSCP heads is discrete, the rotation speed re-adjustment range is about 4.000 to 4.200 rpm.

The wear-out rate is a power function of the pump rotation speed in which the index of power is from 2.5 to 5 (Ivanovsky, V. N. Maximum and Minimum Allowable EPSCPU Rotor Rotating Frequencies while Adjusting Production Capacity for Frequency Converters. Report at the XII-th All-Russian Technical Conference "Manufacture & Operation of Submersible Electric Pump Units," Almetyevsk, Sep. 27-30, 2004, p. 17). A particular value of the index of power depends upon EPSCP operation conditions and modes, mainly upon a suspended particle concentration (SPC) in the liquid to be pumped out.

With increase of the EPSCP rotation speed up to 4.000 rpm, the wear-out rate will increase by a factor of 2.05 to 4.2. The multiplicity of increasing the TBO according to the pump wear-out in short-term well operation as compared to continuous operation is equal to the capacity margin of the unit (Bogdanov, A. A. Submersible Centrifugal Electric Pumps. Moscow, Costoptekhizdat, 1957, p. 129). Therefore, to compensate for the time between overhauls associated with the pump wear-out, the EPSCPU capacity in short-term well operation should be not less than 2.05 times as great as the well production rate, that is, should be more than 2 times greater. Accordingly, the EPSCPU turn-on duration should be less than 50%.

The EPSCPU capacity in the prototype is no more than 2 times as great as the well production rate (Bogdanov, A. A. Submersible Centrifugal Electric Pumps. Moscow, Costoptekhizdat, 1957, p.p. 129-130), in other words, the turn-on duration is not less than 50%.

The working modes of the EPSCP and SEM are calculated such that they operate in the optimal modes, that is, with the maximum efficiency.

A dynamical level of the formation fluid in the annulus of the well is monitored when pumping said liquid out of the well. The dynamical level is monitored by echo-sounder mounted on the wellhead, or in accordance with readings of a pressure sensor at the pump intake of the submersible telemetry system of the EPSCPU.

When the dynamical level achieves a maximum allowable value, the EPSCPU is turned off. Accumulation of the liquid in the well continues either for a design time or until the dynamical level achieves a design value.

After turning the unit on and beginning pumping out, the SEM rotation speed and the EPSCP head, respectively, are controlled by changing the AC frequency at the output of the FC. The control corresponds to readings of the pressure sensor and the flowmeter mounted in the discharge line of the wellhead.

If the EPSCP rotation speed is constant in progress of pumping the liquid out of the well, then, the pump head increases and the pump working mode deviates from the optimal mode when the dynamical level rises. The EPSCP rotation speed is controlled in accordance with readings of the pressure sensor and the flowmeter such that the EPSCP operates in the optimal mode when the liquid is pumped out of the well.

The possibility to implement the invention and achieve the purpose thereof can be demonstrated by the example of calculations.

Initial data for calculation are the following:

$Q=30\ m^3$/day is a well production rate;

$H_S=1{,}500$ m is a unit suspension depth;

$h=1{,}000$ m is a static column height of the liquid above the pump intake;

$H_D=1{,}100$ m is a dynamical level of the formation liquid in the well;

$P_{WH}=10\ kgf/cm^2 \approx 100$ m is a wellhead discharge line pressure;

$P_A=0\ kgf/cm^2$ is a well annulus pressure;

$H_{PUMP}=H_{DYN}+P_{WH}-P_{AN}=1{,}200$ m=1.2 km is a required pump head;

$d_{OWT}=123.7$ mm is an inner diameter of the production string;

$D_K=73$ mm is an outer diameter of OWT;

$S=\pi\cdot(d_{OWT}^2-D_K^2)/4=0.0078\ m^2$ is a well annulus radial clearance area.

Examples

1. Continuous Well Operation by Means of the EPSCPU with an Uncontrollable Drive The most suitable unit for continuous operation of the well having the production rate of 30 $m^3$/day is a unit consisting of the pump ПЦЭНА5-30--1250 composed of two four-meter sections, and an electric motor ПЭД16-117МВ5 (ALNAS Submersible Centrifugal Pump Units. Guide for Operation of ПЦЭНУА РЭ. ЕЮТИ.Н.354.000 РЭ. Almetyevsk, OJSC ALNAS, 2004, p. 57). Their characteristics in the optimal mode are as follows (and may be found at Products & Service Catalogue. Almetyevsk, OJSC ALNAS, 2005. www.alnas.ru/products/pcn):

$Q_{OPT}=37\ m^3$/day is the EPSCP delivery in the optimal mode;

$H_{OPT}=1{,}060$ m is the EPSCP head in the optimal mode;

$\eta_{OPT}=36.5\%$ is the EPSCP efficiency in the optimal mode;

$N_{OПT}=12.21$ kW is power consumed by the EPSCP in the optimal mode;

$P_{RATED}=16$ kW is the rated power of the SEM;

$\eta_{RATED}=84\%$ is the rated efficiency of the SEM;

$s_{RATED}=5\%$ is the rated slip of the SEM.

To fit the capacity of the unit to the well production rate, the pump should be throttled. In doing so, EPSCP characteristics change as follows:

$Q_0=30\ m^3$/day is the EPSCP delivery in the working mode;

$H_0=1{,}250$ m is the EPSCP head in the working mode;

$\eta_0=35\%$ is the EPSCP efficiency in the working mode.

Power consumed by the EPSCP in the working mode will be equal to:

$$N_0=\frac{Q_0\cdot H_0}{8800\cdot\eta_0}=\frac{30\cdot 1250}{8800\cdot 0.35}=12{,}18[\text{kW}].$$

In order to provide the ability of well development, the SEM power is selected with a margin as compared to the EPSCP. Underloading of the SEM results in decrease of its efficiency and slip:

$\eta_{UL}=82\%$ is the SEM efficiency in the working mode;

$s_{UL}=3\%$ is the SEM slip in the working mode.

The EPSCP power is 76.1% of the rated power of the SEM.

The rated torque at the SEM shaft is equal to:

$$M=\frac{P_{RATED}}{\omega}=\frac{60\cdot P_{RATED}}{2\pi\cdot n\cdot(1-s_{UL})}=\frac{60\cdot 16\cdot 10^3}{2\pi\cdot 3000\cdot(1-0.03)}=52{,}5[\text{N}\cdot\text{m}]$$

where n=3000 rpm is a synchronous rotation speed of the SEM.

The maximum rate of lowering the liquid column height in the well annulus at the beginning of pumping the liquid out in development of the well or after the long shutdown thereof is equal to:

$$V_L=\frac{Q_0}{24\cdot 60\cdot S}=\frac{30}{24\cdot 60\cdot 0.0078}=2{,}67[\text{m/min}],$$

that corresponds to the differential pressure drawdown increase rate of 0.27 ($kgf/cm^2$)/min.

The total power consumed by the unit is $$P=\frac{N_0}{\eta_{UL}}=\frac{12{,}18}{0{,}82}=14{,}85[\text{kW}].$$

The specific electric power consumption is $$P_{SP} = \frac{P \cdot 24}{Q_0 \cdot H_R} = \frac{14{,}85 \cdot 24}{30 \cdot 1{,}2} = 9{,}9[\text{kW} \cdot \text{hr/m}^3 \cdot \text{km}].$$

The cost of ПЦЭНА5-30-1250is 136,200 rubles, the cost of ПЭД16--117МВ5 is 131,100 rubles. The control station Elekton-04-250 used together with the present unit has the cost of 89,000 rubles. All prices are indicated without the value added tax (VAT). The costs of other members are not taken into account because they are the same in all variants. The total cost of the equipment is 356,300 rubles without VAT.

2. Continuous Well Operation by Means of the EPSCPU with a Controllable Drive

The most suitable pump for continuous operation of the well having the production rate of 30 $m^3$/day is the pump ПЦЭНА5-18.Its characteristics in the optimal mode are as follows:

$Q_{OPT}$=26 $m^3$/day is the EPSCP delivery in the optimal mode;

$H_{OPT}$=1,160 m is the EPSCP head in the optimal mode;

$\eta_{OPT}$=28.5% is the EPSCP efficiency in the optimal mode;

$N_{OPT}$=12 kW is power consumed by the EPSCP in the optimal mode.

To bring the capacity of the unit in conformity with the well production rate, it is necessary to increase the AC frequency by 1.15 times, that is, up to 57.5 Hz, and to increase the EPSCP rotate speed up to 3,350 rpm. To obtain the necessary head, it is necessary to select the pump ПЦЭНА5-18-1200 composed of the three-meter and four-meter sections and having the follow optimal characteristics at the present speed:

$Q_{OPT}$=30 $m^3$/day is the EPSCP delivery in the optimal mode;

$H_{OPT}$=1,340 m is the EPSCP head in the optimal mode;

$\eta_{OPT}$=29% is the EPSCP efficiency in the optimal mode;

$N_{OPT}$=15.8 kW is power consumed by the EPSCP in the optimal mode.

The combination of the delivery and the head, as required in accordance with the well operation conditions, is not provided. Said delivery and head can be achieved at the rotations speed of 3.250 rpm. The working mode will be non-optimal:

$Q_0$=30 $m^3$/day is the pump delivery in the working mode;

$H_0$=1,200 m is the pump head in the working mode;

$\eta_0$=25% is the pump efficiency in the working mode.

$N_0$=15.7 kW is power consumed by the pump in the working mode.

The TBO in accordance with the pump wear-out will increase by 1.3 to 1.7 times due to increase of the rotation speed.

Power consumed by the pump in the working mode will be equal to:

$$N_0 = \frac{Q_0 \cdot H_0}{8800 \cdot \eta_0} = \frac{30 \cdot 1200}{8800 \cdot 0.25} = 16{,}4[\text{kW}].$$

The maximum allowable multiplicity of the EPSCP rotation speed increase for the production-run SEMs designed to operate at the AC frequency of 50 Hz and the synchronous rotation speed of 3.000 rpm is 1.4 on average. In order to provide the ability of controlling the parameters of the unit by increasing the EPSCP rotations speed, it is necessary to select the SEM with the power margin of $1.4^2$=1.96 times, in other words, it should be the motor ПЭВ32–117МВ5.

Taking into account operation at the higher AC frequency, the decrease of the SEM efficiency will be less than that in the previous variant:

$\eta_{UL}$=83.5% is the SEM efficiency in the working mode;

$s_{UL}$=3% is the SEM slip in the working mode.

The EPSCP power is 51.24% of the rated power of the SEM.

The rated torque at the SEM shaft is equal to:

$$M = \frac{P_{RATED}}{\omega} = \frac{60 \cdot P_{RATED}}{2\pi \cdot n \cdot (1 - s_{UL})} = \frac{60 \cdot 32 \cdot 10^3}{2\pi \cdot 3000 \cdot (1 - 0.03)} = 105[\text{N} \cdot \text{m}].$$

The maximum rate of lowering the liquid column height in the well annulus at the beginning of pumping the liquid out in development of the well of after the long shutdown thereof is equal to:

$$V_L = \frac{Q_0}{24 \cdot 60 \cdot S} = \frac{30}{24 \cdot 60 \cdot 0.0078} = 2{,}67[\text{m/min}],$$

that corresponds to the differential pressure drawdown increase rate of 0.27 (kgf/$cm^2$)/min.

The total power consumed by the unit is $$P = \frac{N_0}{\eta_{UL}} = \frac{16{,}4}{0{,}835} = 19{,}64[\text{kW}].$$

The specific electric power consumption is $$P_{SP} = \frac{P \cdot 24}{Q_0 \cdot H_R} = \frac{19{,}64 \cdot 24}{30 \cdot 1{,}2} = 13{,}09[\text{kW} \cdot \text{hr/m}^3 \cdot \text{km}].$$

The cost of ПЦЭНА5-30-1200is 117,500 rubles, the cost of ПЭД32--117МВ5 is 171,000 rubles. The manufacturer recommends use of the control station Elekton-05-160 together with the present unit, said station having the cost of 268,000 rubles. The total cost of the equipment is 546,500 rubles without VAT. The difference in the equipment cost as compared to continuous well operation by means of the unit with an uncontrollable drive is 200,200 rubles.

Said considerable increase of the equipment cost as compared to continuous well operation by means of the EPSCPU with an uncontrollable drive will most probably not covered within the acceptable period of time. Therefore, the present variant of completing the well with equipment will be discarded because of being unprofitable.

3. Periodical Well Operation by the EPSCPU with an Uncontrollable Drive

The Closest Prior Art Analogue

Units having the capacity no more than 2 times as great as the well production rate are usually used for periodical well operation by means of EPSCPUs with uncontrollable drives (Bogdanov, A. A. Submersible Centrifugal Electric Pumps. Moscow, Costoptekhizdat, 1957, p.p. 129-130). This condition is satisfied by the unit consisting of the pump ПЦЭНА5-45-1300composed of two four-meter sections, and an electric motor ПЭД28-117МВ5.They have characteristics as follows:

$Q_{OPT}$=57 $m^3$/day is the pump delivery in the optimal mode;

$H_{OPT}$=1,120 m is the pump head in the optimal mode;

$\eta_{OPT}$=40% is the pump efficiency in the optimal mode;

$N_{OPT}$=18.14 kW is power consumed by the pump in the optimal mode;

$P_{RATED}$=28 kW is the rated power of the electric motor;

$\eta_{RATED}$=84,5% is the rated efficiency of the electric motor.

The rated torque at the SEM shaft is equal to:

$$M = \frac{P_{RATED}}{\omega} = \frac{60 \cdot P_{RATED}}{2\pi \cdot n \cdot (1 - s_{UL})} = \frac{60 \cdot 28 \cdot 10^3}{2\pi \cdot 3000 \cdot (1 - 0.03)} = 91{,}9[\mathrm{N \cdot m}].$$

Taking into account the dynamical level change in periodical well operation, the EPSCP will operate in the mode as follows:

$Q_0$=52 $m^3$/day is the pump delivery in the working mode;

$H_0$=1,200 m is the pump head in the working mode;

$\eta_0$=39% is the pump efficiency in the working mode.

$N_0$=18.18 kW is power consumed by the pump in the working mode.

The EPSCP power is 65.5 of the rated power of he SEM.

Underloading of the SEM results in decrease of its efficiency:

$\eta_{UL}$ 82.5% is the SEM efficiency in the working mode.

The capacity margin of the unit and therefore the multiplicity of increasing the TBO in accordance with the pump wear-out due to periodicity thereof is equal to:

$$K = \frac{Q_0}{Q} = \frac{52}{30} = 1{,}7.$$

The production rate reduction factor of well when the latter is shifted from continuous to periodic operation is determined by the formula:

$$\varphi = \frac{Q_{PER}}{Q},$$

where $Q_{PER}$ $m^3$/day is a production rate in periodical well operation.

Usually, reduction of the production rate is allowed not greater than by 10%, in other words, usually $\phi$ is set equal to 0.9 Schurov, V. I. Technology and Equipment of Oil Production. Moscow, Nedra, 1983, p. 417).

When the liquid inflow from the formation occurs by the quadratic law, the maximum allowable liquid accumulation-in-well duration is determined by the formula (Reference Book for Oil Production. Edited by Sh. K. Gimautdinov. Moscow, Nedra, 1974, p.p. 269-272):

$$t_{ACC} = \frac{96 \cdot h \cdot S \cdot (1 - \varphi)}{Q} = \frac{96 \cdot 1000 \cdot 0.0078 \cdot (1 - 0.9)}{30} = 2{,}5[\mathrm{hr}].$$

The liquid pumping-out-of-well duration is determined by the formula:

$$t_{P\text{-}OUT} = \frac{t_{ACC} \cdot \varphi}{K - \varphi} = \frac{2.5 \cdot 0.9}{1.9 - 0.9} = 2{,}25 \ [\mathrm{hr}].$$

The well operation period duration will be $$T = t_{ACC} + t_{P\text{-}OUT} = 2.5 + 2.25 = 4.75 \ [\mathrm{hr}].$$

The EPSCP turn-on duration is equal to:

$$k = \frac{t_{P\text{-}OUT}}{T} \cdot 100 = \frac{2.25}{4.75} \cdot 100 = 47{,}4 \ [\%].$$

Since structures of SEMs are filled with lubricant oil, their heat capacity is sufficiently large. To establish thermal equilibrium of the SEM with the cooling medium when operating at the rated load, 20 to 40 minutes are necessary depending upon power of the electric motor and conditions for its cooling. Therefore, the obtained values of the liquid pumping-out-of-well duration make it possible to conclude that the electric motor of the unit operates in the long-term mode (the typical mode S1 according to GOST 28173-39 E and IEC 34-1-82).

Other members of the EPSCP have a smaller heat capacity as compared to the SEM. Therefore, their working modes can be characterized as long-term ones as well.

In order to reduce the negative effect of overloads upon the time between overhauls, there is practice to establish a greater operation period wherein further reduction of the oil production volume is allowable. The operation period is usually set equal to 24 hours and the unit is put into operation at night time when electric power tariffs are minimal.

The maximum rate of lowering the liquid column height in the well annulus at the beginning of pumping the liquid out in development of the well after the long shutdown thereof is equal to:

$$V_L = \frac{Q_0}{24 \cdot 60 \cdot S} = \frac{52}{24 \cdot 60 \cdot 0.0078} = 4{,}63 \ [\mathrm{m/min}],$$

that corresponds to the differential pressure drawdown increase rate of 0.46 (kgf/$cm^2$)/min.

The total power consumed by the unit is $$P = \frac{N_0}{\eta_{UL}} = \frac{18{,}18}{0{,}825} = 22{,}04 \ [\mathrm{kW}].$$

The average consumed power is $$\bar{P} = \frac{P \cdot t_{P\text{-}OUT}}{T} = \frac{22.04 \cdot 2.25}{4.75} = 10{,}44 \ [\mathrm{kW}].$$

The specific electric power consumption is $$P_{SP} = \frac{\bar{P} \cdot 24}{Q \cdot \phi \cdot H_R} = \frac{10{,}44 \cdot 24}{30 \cdot 0{,}9 \cdot 1{,}2} = 7{,}73 \ [\mathrm{kW \cdot hr/m^3 \cdot km}].$$

The cost of ПЦЭНА5-45-1300 is 136,000 rubles, the cost of ПЭД28--117МВ5 is 159,600 rubles. The control station Elekton-04-250 has the cost of 89,000 rubles. The total cost of the equipment is 384,600 rubles without VAT. The difference in the equipment cost as compared to continuous well operation by means of the unit with an uncontrollable drive is 28,300 rubles.

4. Short-Term Well Operation by the EPSCPU

There are two oppositely acting factors having an influence upon the time between overhauls associated with the pump wear-out in short-term well operation: the EPSCP wear-out increase due to increase of the rotation speed; and the wear-out decrease due to the EPSCP turn-on duration decrease. In order to increase the TBO in accordance with the pump wear-out even in under most unfavorable operating conditions, it is necessary to have the capacity of the unit not less than $$Q_{OPT} \geqq Q \cdot 1.4^5 = 30 \cdot 5.4 = 161.3 \text{ [m}^3\text{/day]}.$$

This condition is satisfied by the pump ПЦЭНА5-135-700composed of one five-meter section. The head thereof is $H_{OPT}$=1.320 m at the AC frequency of 70 Hz and the rotation speed of 4.200 rpm.

To provide more accurate adjustment of the head, it will be necessary to lower the AC frequency down to 66.7 Hz and to lower the rotation speed down to 4.000 rpm. In this case, EPSCP and SEM characteristics will be as follows:

$Q_{OPT}$=173 $m^3$/day is the pump delivery in the optimal mode;

$H_{OPT}$=1,200 m is the pump head in the optimal mode;

$N_{OPT}$=39.3 kW is power consumed by the pump in the optimal mode;

$\eta_{OPT}$=61% is the pump efficiency in the optimal mode.

As a drive for the present EPSCP, the electric motor ВЭВ32--117МВ5 will be necessary which will have the following characteristics at the AC frequency of 66.7 Hz:

$P_{RATED}$=42.7 kW is the rated power of the electric motor;

$\eta_{RATED}$=85.5% is the rated efficiency of the electric motor.

The rated torque at the SEM shaft at the AC frequency of 50 Hz will be equal to:

$$M = \frac{P_{RATED}}{\omega} = \frac{60 \cdot P_{RATED}}{2\pi \cdot n \cdot (1 - s_{UL})} = \frac{60 \cdot 32 \cdot 10^3}{2\pi \cdot 3000 \cdot (1 - 0.03)} = 105 \text{ [N·m]}.$$

Taking into account that one-section EPSCPs having a smaller starting torque are used in short-term well operation but not two-section EPSCPs as in all other prior art methods for well operation, and that the more powerful SEMs are used, the conclusion is possible that the conditions for starting EPSCPUs in short-term well operation are the most favorable.

Because of increasing the rotation speed, the coefficient of TBO reduction in accordance with the pump wear-out will be 2.05 to 4.2.

The capacity margin of the unit and therefore the multiplicity of increasing the TBO in accordance with the pump wear-out due to reducing the EPSCPU turn-on duration is equal to $$K = \frac{Q_{OPT}}{Q} = \frac{173}{30} = 5{,}77$$

As a result of action of the two factors having an influence, the TBO in accordance with the pump wear-out will increase by 1.4 to 2.8 times.

It periodical well operation by means of EPSCPUs with controllable electrical drives, it is possible to set $\phi \geqq 0.99$, i.e. to allow the production rate reduction not more than by 1%.

The maximum allowable liquid accumulation-in-well duration will be equal to:

$$t_{ACC} = \frac{96 \cdot h \cdot S \cdot (1 - \varphi)}{Q} = \frac{96 \cdot 1000 \cdot 0.0078 \cdot (1 - 0.99)}{30} = 0.25 \text{ [hr]} \approx 15 \text{ [min]}.$$

The liquid pumping-out-of-well duration is equal to:

$$t_{P\text{-}OUT} = \frac{t_{ACC} \cdot \varphi}{K - \varphi} = \frac{15 \cdot 0.99}{7 - 0.99} = 2{,}5 \text{ [min]}.$$

The well operation period duration will be $$T = t_{ACC} + t_{P\text{-}OUT} = 15 + 2.5 = 17.5 \text{ [min]}.$$

The EPSCPU turn-on duration is equal to:

$$k = \frac{t_{P\text{-}OUT}}{T} \cdot 100 = \frac{2.5}{17{,}5} \cdot 100 = 14{,}3 \text{ [\%]}.$$

The obtained values of the liquid pumping-out-of-well duration and the EPSCPU turn-on duration defines the working mode of the unit as short-term one.

The maximum rate of lowering the liquid column height in the well annulus at the beginning of pumping the liquid out in development of the well of after the long shutdown thereof is equal to:

$$V_L = \frac{Q_{OPT}}{24 \cdot 60 \cdot S} = \frac{173}{24 \cdot 60 \cdot 0.0078} = 15{,}4 \text{ [m/min]},$$

that corresponds to the differential pressure drawdown increase rate of 1.54 (kgf/$cm^2$)/min.

The rate of increasing differential pressure drawdown is several times greater as compared to other prior art method for well operation. Therefore, short-term well operation makes it possible to develop well quickly and qualitatively and also to execute operations for intensifying the inflow of the liquid into the well without stoppage and lift of the equipment out of the well.

The instantaneous power consumed by the unit is $$P = \frac{N_{OPT}}{\eta_{RATED}} = \frac{39{,}3}{0{,}855} = 45{,}97 \text{ [kW]}.$$

The average consumed power is $$\bar{P} = \frac{P \cdot t_{P\text{-}OUT}}{T} = \frac{45{,}97 \cdot 2.5}{17{,}5} = 6{,}57 \text{ [kW]}.$$

The specific electric power consumption will be equal to:

$$P_{SP} = \frac{\bar{P} \cdot 24}{Q \cdot \phi \cdot H_R} = \frac{6{,}57 \cdot 24}{30 \cdot 0{,}99 \cdot 1{,}2} = 4{,}42 \text{ [kW·hr/m}^3\text{·km]}.$$

The cost of ПЦЭНА5-125-700rubles, the cost of ПЭД32--117МВ5 is 171,000 rubles. Similarly to other equipment, the control station having the frequency converter operates in the short-term mode. Therefore, it is possible to use the CS Elekton-04-250 with the FC, said station having power of 63 kVA (40 kW at cos $\phi$=0.86) and the cost of 127,000 rubles. The total cost of the equipment is 376,700 rubles. The difference in the equipment cost as compared to continuous well operation by means of the unit with an uncontrollable drive is only 20,400 rubles.

The calculations above confirm realization of the invention and achievement of the object of the invention. Short-term well operation allows increase of oil production volumes, increase of the time between overhauls, provision of the minimum electric power consumption and insignificant increase of the equipment cost.

There occurs a synergistic effect in short-term well operation, because the positive effect caused by the combination of technical solutions upon increase of the time between overhauls and the service life of the equipment as well as upon reduction of the electric power consumption, is higher than a result of influence of each technical solution separately.

The results of executed calculations demonstrate that short-term well operation by means of EPSCPUs with controllable electrical drives provides the highest profitability within the complex of all indicia among considered methods for well operation by mechanical means.

The invention claimed is:

1. A method of short-term well operation to produce a liquid from a well by a submersible impeller pump unit with an electrical drive and a productive capacity of greater than 80 cubic meters per day, said method comprising:

alternating pumping a liquid out of a well when said unit is turned on and accumulating a liquid in the well when the unit is turned off;

adjusting an average integral-in-time capacity of said unit by changing a proportion between a time interval of pumping the liquid out of the well and a time interval of accumulating the liquid in the well in order to bring said productive capacity in conformity with a well production rate;

adjusting a pressure produced by said unit during the time interval of pumping the liquid out of the well by changing a rotation velocity of said unit such that an efficiency of said unit is at least 0.9 of a maximum value of said efficiency for a given rotation velocity of said unit throughout an adjustment range;

selecting a time interval of a complete operational cycle of said unit equal to a sum of said time interval of pumping the liquid out of the well and said time interval of accumulating the liquid in the well so as to have a production rate reduction factor greater than 0.95 as compared to a production rate reduction factor of continuous well operation; and selecting a factor of cyclic time interval of unit turning-on equal to a ratio of said time interval of pumping the liquid out of the well to said time interval of the complete operational cycle of said unit so that said factor is less than 50%.

* * * * *